US005729858A

United States Patent [19]

Riffel

[11] Patent Number: 5,729,858

[45] Date of Patent: Mar. 24, 1998

[54] FOOT SCRUBBING SYSTEM

[76] Inventor: Sophia M. Riffel, R.R. #5 Box 484, Spencer, Ind. 47460

[21] Appl. No.: 866,133

[22] Filed: May 30, 1997

[51] Int. Cl.[6] ..... A46B 5/00; A61H 7/00

[52] U.S. Cl. ..... 815/111; 15/160; 15/161; 4/606; 4/622; 601/136

[58] Field of Search ..... 15/104.92, 161, 15/160, 159.1, 184, 111, 112, 113, 106, 207.2; 601/136; 4/606, 622, 628

[56] References Cited

U.S. PATENT DOCUMENTS

| | | | |
|---|---|---|---|
| 414,007 | 10/1889 | Boeckh | 15/112 |
| 895,458 | 8/1908 | Herzog | 15/112 |
| 1,168,341 | 1/1916 | Simmons | 15/112 |
| 1,327,943 | 1/1920 | Cohen | 15/112 |
| 2,591,331 | 4/1952 | Baumbach | 15/161 |
| 3,416,178 | 12/1968 | James | 15/104.92 |
| 4,617,917 | 10/1986 | Miller | 15/104.92 |
| 5,177,829 | 1/1993 | Simpson | 15/104.92 |
| 5,321,867 | 6/1994 | Probst | 601/136 |

*Primary Examiner*—Gary K. Graham

[57] ABSTRACT

A foot scrubbing system including a base member. A plurality of suction cups are disposed on a lower surface of the base member. A plurality of foot bristles extend upwardly from the base member. Three toe bristles are disposed within the base member inwardly of an end portion thereof.

1 Claim, 2 Drawing Sheets

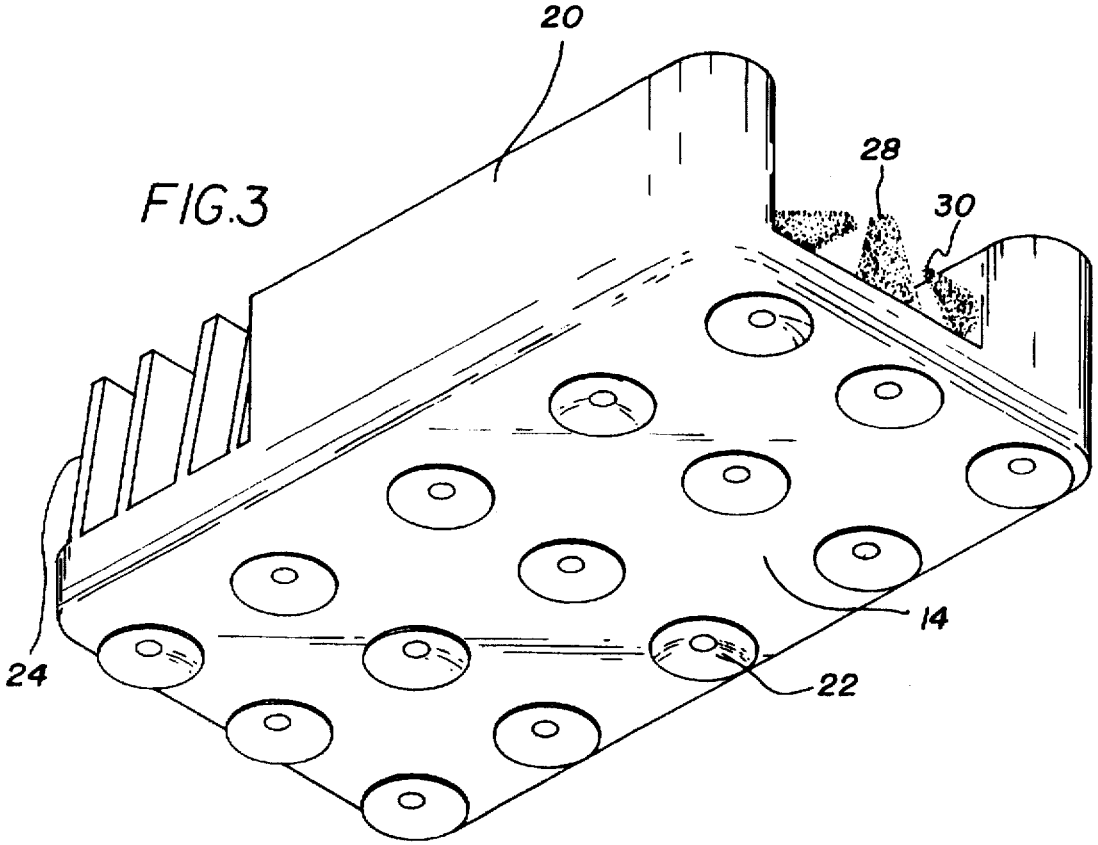
FIG.3
FIG.4
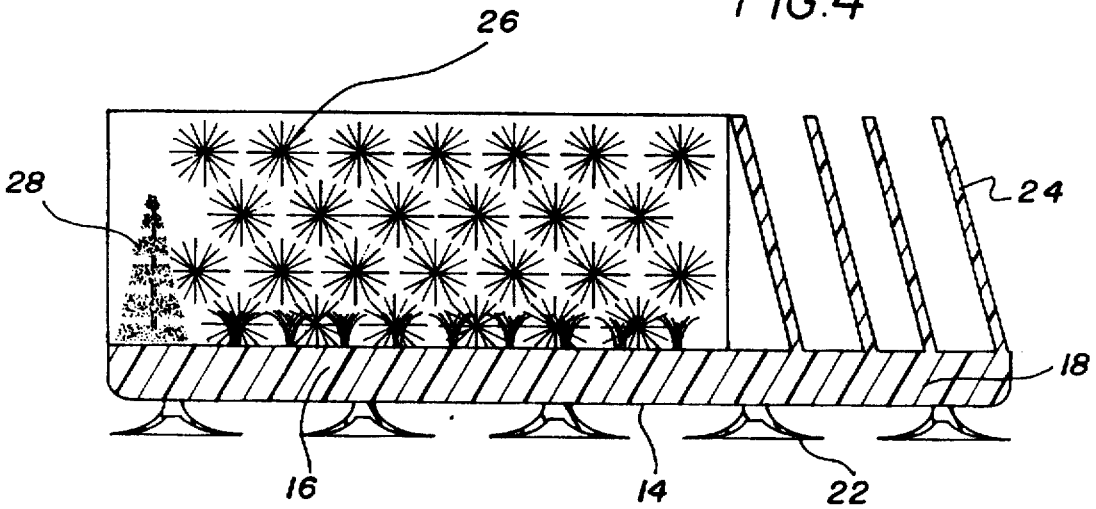

FOOT SCRUBBING SYSTEM

BACKGROUND OF THE INVENTION

1. Field of the Invention

The present invention relates to a foot scrubbing system and more particularly pertains to allowing a user's feet to be washed within a shower with a foot scrubbing system.

2. Description of the Prior Art

The use of foot washing devices is known in the prior art. More specifically, foot washing devices heretofore devised and utilized for the purpose of washing a person's feet are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,321,867 to Probst discloses a foot washing apparatus. U.S. Pat. No. 4,617,917 to Miller discloses a foot hygiene device. U.S. Pat. No. Des. 343,476 to Tomsick discloses the ornamental design for a bathtub foot scrubber. U.S. Pat. No. 5,345,641 to Webster discloses a portable footwear cleaner. U.S. Pat. No. 5,163,200 to Carlin et al. discloses a foot scrubbing apparatus. U.S. Pat. No. Des. 280,868 to Russell discloses the ornamental design for a foot scrubber.

While these devices fulfill their respective, particular objective and requirements, the aforementioned patents do not describe a foot scrubbing system for allowing a user's feet to be washed within a shower.

In this respect, the foot scrubbing system according to the present invention substantially departs from the conventional concepts and designs of the prior art, and in doing so provides an apparatus primarily developed for the purpose of allowing a user's feet to be washed within a shower.

Therefore, it can be appreciated that there exists a continuing need for new and improved foot scrubbing system which can be used for allowing a user's feet to be washed within a shower. In this regard, the present invention substantially fulfills this need.

SUMMARY OF THE INVENTION

In the view of the foregoing disadvantages inherent in the known types of foot washing devices now present in the prior art, the present invention provides an improved foot scrubbing system. As such, the general purpose of the present invention, which will be described subsequently in greater detail, is to provide a new and improved foot scrubbing system and method which has all the advantages of the prior art and none of the disadvantages.

To attain this, the present invention essentially comprises a base member comprising a bottom wall having a generally rectangular configuration. The bottom wall has a forward section and a rearward section. The forward section has a pair of side walls extending upwardly therefrom. A plurality of suction cups are disposed on a lower surface of the base member. A plurality of skin removing ridges extend angularly from an upper surface of the rearward section of the base member. Upper ends of the ridges are equal in height to the pair of side walls. A plurality of foot bristles extend upwardly from the forward section of the base member and extend inwardly from the pair of side walls. The plurality of foot bristles are arranged in rows of four on the side walls and in a row of three on the forward section. Three toe bristles are disposed within the forward section of the base member inwardly of an end portion thereof. The three toe bristles include a central toe bristle extending upwardly from the base member and two angularly disposed side toe bristles disposed on opposing sides of the central toe bristles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foot scrubbing system which has all the advantages of the prior art foot washing devices and none of the disadvantages.

It is another object of the present invention to provide a new and improved foot scrubbing system which may be easily and efficiently manufactured and marketed.

It is a further object of the present invention to provide a new and improved foot scrubbing system which is of durable and reliable construction.

An even further object of the present invention is to provide a new and improved foot scrubbing system which is susceptible of a low cost of manufacture with regard to both materials and labor, and which accordingly is then susceptible of low prices of sale to the consuming public, thereby making such a foot scrubbing system economically available to the buying public.

Even still another object of the present invention is to provide a new and improved foot scrubbing system for allowing a user's feet to be washed within a shower.

Lastly, it is an object of the present invention to provide a new and improved foot scrubbing system including a base member. A plurality of suction cups are disposed on a lower surface of the base member. A plurality of foot bristles extend upwardly from the base member. Three toe bristles are disposed within the base member inwardly of an end portion thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom perspective view of the present invention illustrating the suction cups thereof.

FIG. 4 is a cross-sectional view of the present invention as taken along line 4—4 of FIG. 2.

The same reference numerals refer to the same parts through the various figures.

DESCRIPTION OF THE PREFERRED EMBODIMENT

Figure 1:
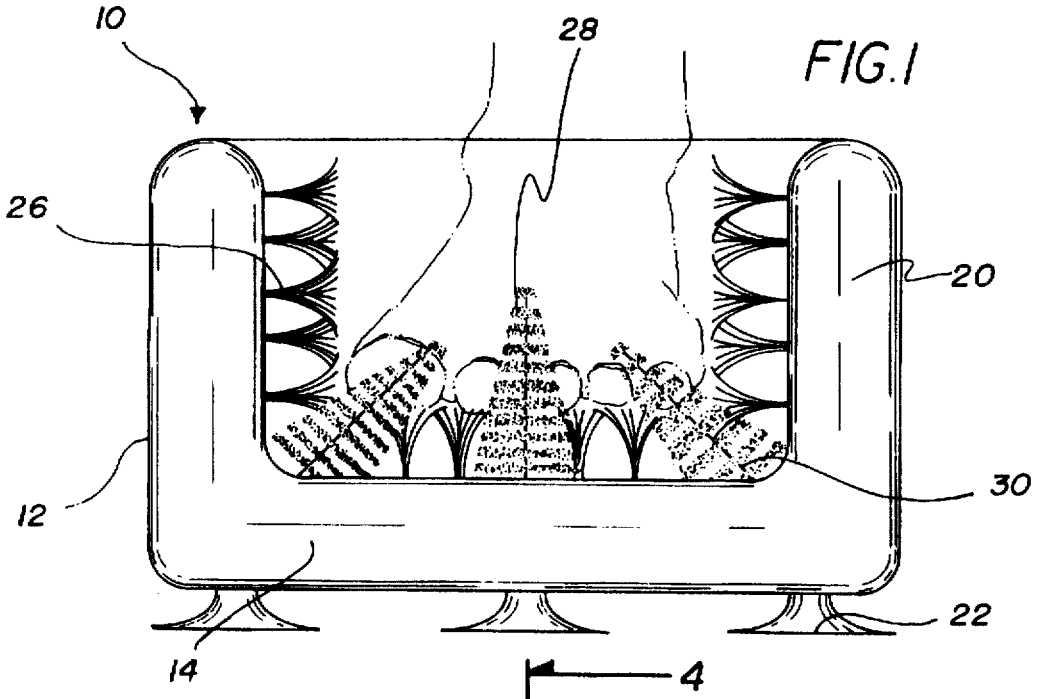
FIG. 1 is a front elevation view of the preferred embodiment of the foot scrubbing system constructed in accordance with the principles of the present invention.
Figure 2:
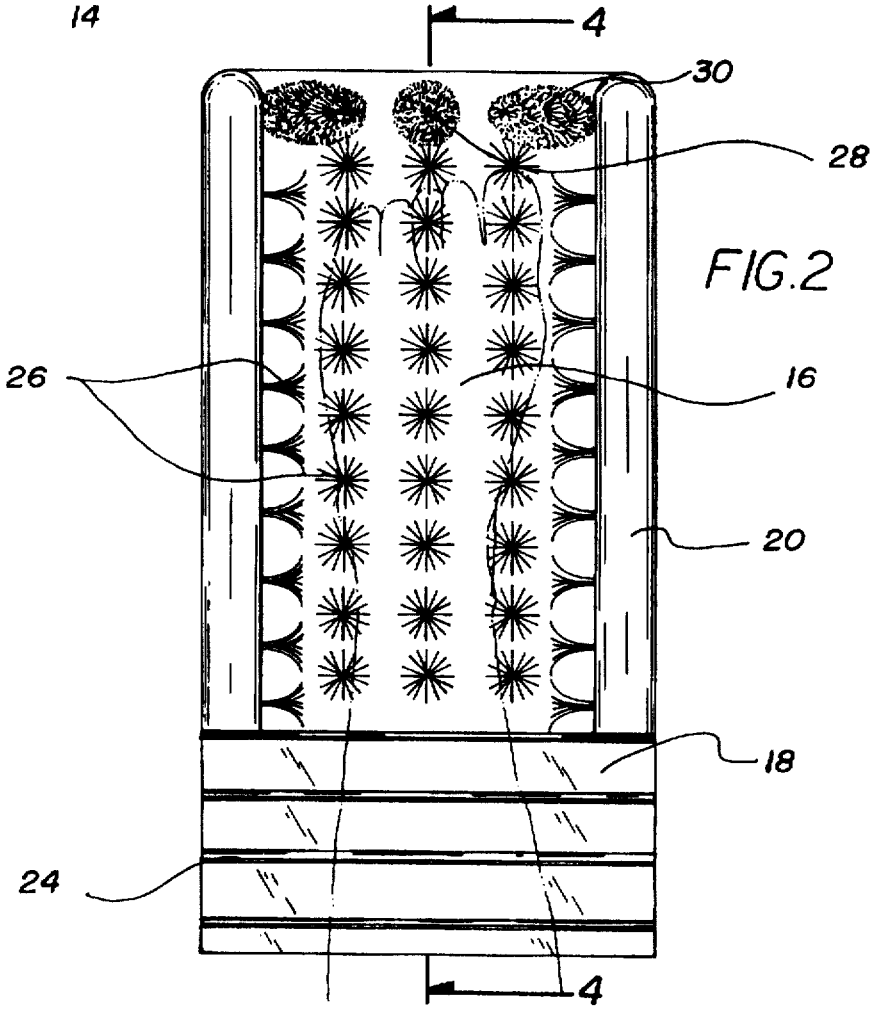
FIG. 2 is a top plan view of the present invention as shown in FIG. 1.

With reference now to the drawings, and in particular, to FIGS. 1 through 4 thereof, the preferred embodiment of the new and improved foot scrubbing system embodying the principles and concepts of the present invention and generally designated by the reference number 10 will be described.

Specifically, it will be noted in the various Figures that the device relates to a foot scrubbing system for allowing a user's feet to be washed within a shower. In its broadest context, the device consists of a base member, a plurality of suction cups, a plurality of skin removing ridges, a plurality of foot bristles and three toe bristles. Such components are individually configured and correlated with respect to each other so as to attain the desired objective.

The base member 12 comprises a bottom wall 14 having a generally rectangular configuration. The bottom wall 14 has a forward section 16 and a rearward section 18. The forward section 16 has a pair of side walls 20 extending upwardly therefrom. The forward section 16 has a length of at least twelve inches to accommodate a human foot.

The plurality of suction cups 22 are disposed on a lower surface of the base member 12. The suction cups 22 are spaced evenly along the base member, note FIG. 3, and allow the system 10 to be secured within a bath tub or shower stall.

The plurality of skin removing ridges 24 extend angularly from an upper surface of the rearward section 18 of the base member 12. Upper ends of the ridges are equal in height to the pair of side walls 20. Note FIG. 4. In the preferred embodiment, four rides 24 are provided. The ridges 24 allow for the user to rub the bottom of their feet over the ridges 24 to remove any dry or dead skin from the foot.

The plurality of foot bristles 26 extend upwardly from the forward section 16 of the base member 12 and extend inwardly from the pair of side walls 20. The plurality of foot bristles 26 are arranged in rows of four on the side walls 20 and in a row of three on the forward section 16. Note FIGS. 1 and 4. The foot bristles 26 allow the user to scrub their entire foot.

The three toe bristles are disposed within the forward section 16 of the base member 12 inwardly of an end portion thereof. The three toe bristles include a central toe bristle 28 extending upwardly from the base member 12 and two angularly disposed side toe bristles 30 disposed on opposing sides of the central toe bristles 28. The angular disposition of the three toe bristles allow for the in-between areas of all five toes of the foot to be properly cleaned.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A foot scrubbing system for allowing a user's feet to be washed within a shower comprising, in combination:

a base member comprising a bottom wall having a generally rectangular configuration, the bottom wall having a forward section and a rearward section, the forward section having a pair of side walls extending upwardly therefrom;

a plurality of suction cups disposed on a lower surface of the base member;

a plurality of skin removing ridges extending angularly from an upper surface of the rearward section of the base member, upper ends of the ridges equal in height to the pair of side walls;

a plurality of foot bristles extending upwardly from the forward section of the base member and extending inwardly from the pair of side walls, the plurality of foot bristles arranged in rows of four on the side walls and in a row of three on the forward section; and three toe bristles disposed within the forward section of the base member inwardly of an end portion thereof, the three toe bristles including a central toe bristle extending upwardly from the base member and two angularly disposed side toe bristles disposed on opposing sides of the central toe bristles.

* * * * *